US006012363A

United States Patent [19]

Minkin

[11] Patent Number: 6,012,363

[45] Date of Patent: Jan. 11, 2000

[54] EXTENDED REACH PLIERS

[76] Inventor: Herman Minkin, 23 Montana Pl., Brooklyn, N.Y. 11234

[21] Appl. No.: 08/904,524

[22] Filed: Aug. 1, 1997

Related U.S. Application Data

[63] Continuation-in-part of application No. 08/660,119, Jun. 7, 1996, abandoned.

[51] Int. Cl.[7] ..... B25B 7/12

[52] U.S. Cl. ..... 81/383; 81/381; 7/107; 294/119

[58] Field of Search ..... 81/342, 381, 383; 7/107, 125; 294/118, 119

[56] References Cited

U.S. PATENT DOCUMENTS

| | | |
|---|---|---|
| 557,480 | 3/1896 | Boyd . |
| 656,492 | 8/1900 | Vogel . |
| 718,790 | 1/1903 | Pervier . |
| 724,829 | 4/1903 | Eberth . |
| 727,279 | 5/1903 | Brindos . |
| 1,337,101 | 4/1920 | Stovall . |
| 1,484,100 | 2/1924 | Wertz . |
| 1,549,836 | 8/1925 | Hopp . |
| 2,507,710 | 5/1950 | Grosso . |
| 2,668,538 | 2/1954 | Baker . |
| 2,743,726 | 5/1956 | Grieshaber . |
| 3,092,152 | 6/1963 | Neff . |
| 3,384,411 | 5/1968 | Zlotnicki . |
| 3,710,406 | 1/1973 | Stanford . |
| 4,805,493 | 2/1989 | Stein . |

FOREIGN PATENT DOCUMENTS

| | | |
|---|---|---|
| 176217 | 3/1922 | United Kingdom . |

OTHER PUBLICATIONS

Mac Tools catalog 1997, p. 114.
Snap–on Tools 75th Anniversary catalog, 1995, p. 160.
Matco catalog, 1996–1997, p. 150.
Harbor Freight Tools catalog, Summer 1997, p. 8.
Craftsman catalog, 1996–1997, p. 52.

*Primary Examiner*—David A. Scherbel
*Assistant Examiner*—Joni B. Danganan
*Attorney, Agent, or Firm*—Gibbons, Del Deo, Dolan, Griffinger & Vecchione

[57] ABSTRACT

A manuallly operated tool, wherein the manipulation of handles at one end of the tool results in a corresponding movement in jaws at the opposite end. The tool includes two handle elements, wherein each handle element has a first end and a second end. A first pivot joins the two handle elements together so that the distance between the first ends of each handle element and the first pivot is more than twice as long as the distance between the second ends and the first pivot. Two jaw elements are also provided, Wherein each jaw element has a working head end and an opposite tail end. A second pivot joins each of the jaw elements together so that the distance between the tip of each working head end and the second pivot is at least twice as long as the distance between each tail end and the second pivot. The jaw elements are pivotably connected to the handle elements, whereby the length of the handle elements in proportion to the jaw elements provide a mechanical advantage to the jaw elements of at least 2:1.

20 Claims, 7 Drawing Sheets

EXTENDED REACH PLIERS

RELATED APPLICATIONS

This application is a continuation-in-part of U.S. patent application Ser. No. 08/660,119, filed Jun. 7, 1996, now abandoned.

BACKGROUND OF THE INVENTION

I. Field of the Invention

The present invention relates generally to pliers and similar hand manipulated tools where the movement ot handle elements of the tool causes a corresponding movement in jaw elements of the tool. More particularly, the present invention relates to pliers and like hand tools that have a long working length and include multiple pivot points between the jaw elements of the tool and the point where the tool is engaged by the hand.

II. Description of the Prior Art

The prior art is replete with different types of hand tools for use in particular applications. Many such prior art tools fall under the general category of pliers, wherein the tools have working jaws, handle elements and at least one pivot point, whereby the movement of the handle elements is directly proportional to the movement of the working jaws. Traditional pliers only have a single pivot point. The primary purpose of traditional pliers is to provide a mechanical advantage in gripping force so that a person using the pliers can manually turn a nut or perform a similar task. A major disadvantage with single pivot traditional pliers is that in order to open the jaws of the pliers widely, the handle elements of the pliers must also be opened widely. Such configurations therefore limit the application of traditional pliers and other currently manufactured pliers to situations where there is a relatively wide area of space available to manipulate the pliers. However, if an object to be worked upon is in a restricted area having a diameter less than two inches and a depth of more than three inches, then many traditional single pivot pliers cannot be used. In such applications, currently available deep reach pliers such as "needle nose" or "duckbill" pliers would have to be used in order to reach the object at the bottom of the restricted enclosure. Such currently available deep reach pliers also only have a single pivot. As a result, with a needed jaw opening width of at least ¼ inch, such deep reach pliers typically only would have an effective reach in a restricted enclosure of up to four inches.

Those common types of deep reach pliers on the market today include elongated jaw and/or handle elements, such as those embodied, for example, in the Craftsman Power and Hand Tools caitalog, 1996–1997, page 52, the MAC Tools catalog, 1997, page 114, The Snap-On 75th Anniversary catalog, 1995, page 160 and the MATCO Tools Professional Hand Tools and Service Equipment Catalog, page 150. Since such single pivot deep reach pliers have elongated jaws, the mechanical advantage of such deep reach pliers is often less than 2:1. Consequently, even if an object is reachable by these currently available deep reach pliers, the pliers may not be able to manipulate the object. Moreover, the longer the jaw elements, the more flexible they become and thus there is a limited amount of twisting motion or torque that can be applied using such tools.

Recognizing the physical liiitations of traditional single pivot pliers and other tools, many tools in the prior art have adapted a construction where multiple pivot points exist between the handles of the tool and the jaws of the tool. A common application of such a tool is a bolt cutter. In traditional bolt cutters, multiple pivots are used to create an extremely large mechanical advantage at the jaws. As such, the gained mechanical advantage enables a person's manual force to cut the hardened steel of a bolt or padlock. However, in order to create such large mechanical advantages, bolt cutters must be configured so that a large movement in the handles results in only a small movement in the jaws. As a result, in order to open the jaws of a bolt cutter wide enough to engage a bolt, the handles of a bolt cutter may have to be opened well over twenty times as wide as the jaws. Consequently, the multi-pivoted construction of bolt cutters cannot be adapted to pliers that work in highly space restricted areas.

Another application of plier-like tools that have multiple pivot points is tongs. Unlike pliers, the purpose of tongs is to generally grasp an object for the purpose of moving the object. As such, tongs are generally designed to provide little or no mechanical advantage to its jaws. Many types of tongs, such as the tongs exemplified by U.S. Pat. No. 1,337,101 to Stovall, entitled TIE HANDLING TONGS and U.S. Pat. No. 718,790 to Pervier, entitled ICE TONGS provide mechanical advantages of 1:1 or less. A common feature of tongs is that the jaws of tongs must open widely in order for the tongs to engage whatever object the tongs were designed to engage. In order to design a multi-pivoted tong that is capable of having wide opening jaws, the tongs must be designed so that either the handles of the tongs open widely or the pivot joints of the tongs spread widely during use. Since such tongs either spread widely and/or provide no significant mechanical advantage, the configuration of such tongs cannot be adapted to pliers that must operate in a confined area and must provide a significant mechanical advantage. Such is the case with the tongs exemplified in U.S. Pat. No. 727,279 to Brindos entitled LOGGING OR TIE HANDLING TONGS, where the jaw elements open to a width that is greater than the width of the pivot elements. This fact, combined with the general structure of the Brindos tool, which includes, for example, handle elements at pivot locations would make the Brindlos tool inappropriate for accessing a restricted area.

Pliers with multiple pivot points do exist as is exemplified by U.S. Pat. No. 2,507,710 to Grosso, entitled ADJUSTABLE-ANGLE SURGICAL INSTRUMENT and U.S. Pat. No. 557,480 to Boyd, entitled SKELP TONGS. Such prior art devices do provide a mechanical adsiantage to the jaws of the pliers. However, in each case, the middle of the three pivot junctions must open to a width significantly wider than the plier jaws. Consequently, the width of the middle pivot junction is wider than the jaws and prevents the application of the pliers to highly restricted areas.

There are many applications where a tool such as a pair of pliers, a cutter, a clamp or other like tool must be applied deep within a narrow opening. Mechanics often come across such situations. In such situations, a wide tool simply cannot be used because the wide tool will not physically fit into the space available. For example, most presently manufactured automobiles, trucks, as well as aircraft, have extensive metal tubing, rubber hoses, air conditioning lines, wiring harnesses and the like which can substantially block access to the mechanicals below. In applications such as surgery, surgeons must often reach deep into the body during surgery. In order to limit the size of incisions and reduce trauma to surrounding tissues and organs, tools are required that are as narrow as possible.

In view of the prior art, a long felt need exists in the prior art for pliers and similar tools that are capable of being used in highly restricted areas, yet provide a significant mechanical advantage in gripping force. This need has not been readily met by the tools in the described prior art, nor has it been met by tools from leading tool manufacturers which are on the market today. Such a need is met by the present invention as described and claimed below.

SUMMARY OF THE INVENTION

The present invention is a manually operated tool, wherein the manipulation of handles at one end of the tool results in a corresponding movement in jaws at the opposite end of the tool. The tool can be embodied as pliers, cutters or any other configuration that requires the selective opening and closing of jaw elements for its operation. The tool includes two handle elements, wherein each handle element has a first end and a second end. A first pivot joins the two handle elements together so that the distance between the first end of each handle element and the first pivot is more than twice as long as the distance between the second end of each handle element and the first pivot. Two jaw elements are also provided, wherein each jaw element has a working head end and an opposite tail end. The configuration of the working head end determines if the tool is a pair of pliers, cutters or the like. A second pivot joins each of the jaw elements together so that the distance between the tip of each working head end and the second pivot is at least twice as long as the distance between each tail end and the second pivot. The jaw elements are pivotably connected to the handle elements, w hereby the length of the handle elements in proportion to the jaw elements provides a mechanical advantage to the jaw elements of at least 2:1. Furthermore, in the proportions given, the present invention tool is capable of extending deep into a confined area, while still being capable of providing a large jaw opening.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWING

Although the configuration of the present invention can be used in the creation of a cutting tool, duck bill, needle nose or similar tool for use in a confined area, the present invention is especially well suited for use as pliers, wherein the jaws of the pliers are flat and are adapted to access a hard to reach object, such as a cotter key, retaining clip, bolt head or nuit and safety wire. Accordingly, by way of example, the present invention will be herein described embodied as a pair of pliers.

Figure 1:
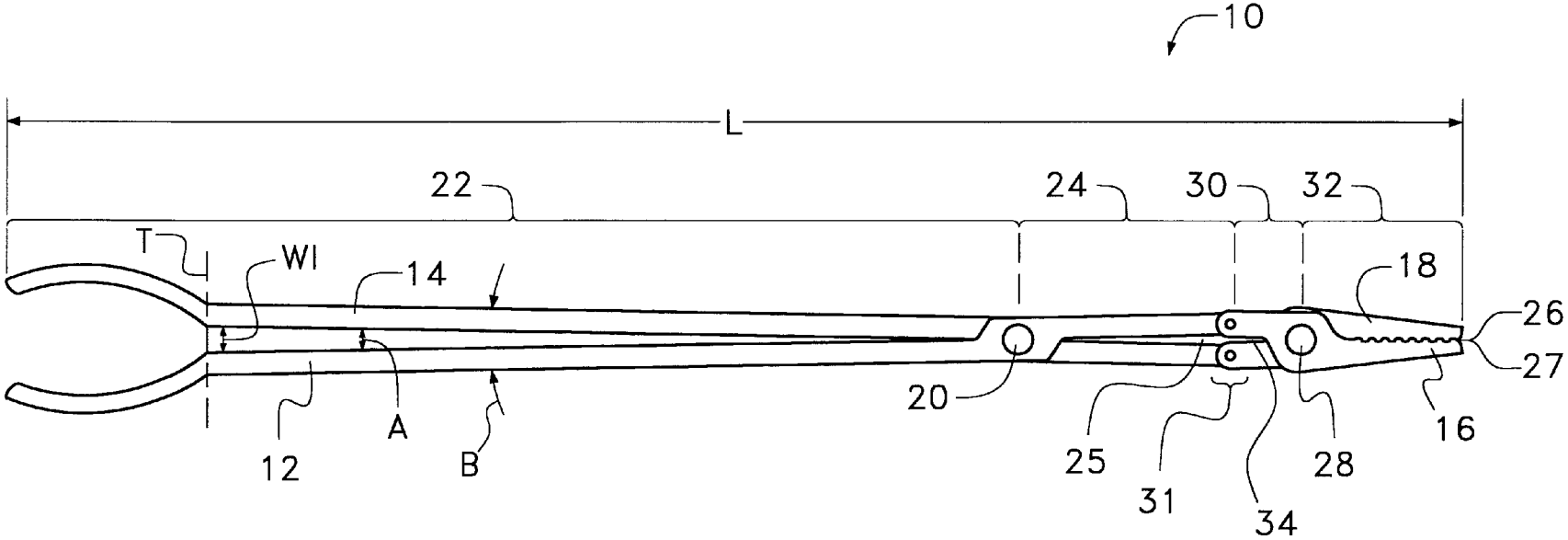
FIG. 1 is a side view of one embodiment of a pair of pliers made in accordance with the present invention wherein the pliers are shown in a closed condition.

Referring to FIG. 1, a pair of pliers 10 is shown in accordance with the present invention. The pliers 10 have an overall length L which can be any length but is preferably between five inches and twenty four inches. The pliers 10 are comprised of two handle elements 12, 14 and two jaw elements 16, 18. The handle elements 12, 14 are pivotably coupled to each other by pivot 20. As such, the handle elements 12, 14 are distinguishable into two regions 22, 24, wherein region 22 extends from one end to pivot 20 and region 24 extends from pivot 20 toward the jaw elements 16, 18. In FIG. 1, the pair of pliers 10 is shown in a closed condition, whereby the work surfaces 26, 27 on the jaw elements 16, 18 are biased against one another. In this configuration, it can be seen that the handle elements 12, 14 in region 22 do not touch each other. Rather, the handle elements 12, 14 in region 22 diverge away from one another at an acute angle A, which may be between 1 degree and 5 degrees. Each handle element 12, 14 is also slightly tapered, wherein the handle elements 12, 14 are thickest near pivot 20. As such, it should be understood that the acute angle B defined by the exterior of the handle elements 12, 14 is slightly less than that of the acute angle A defined by the interior of the handle elements 12, 14. It should be understood, however, that depending upon the application for the piers 10, the thickness of the handles may be varied to an extent where the handle elements essentially touch when in a closed position and that the taper to the handles may or may not exist.

The handle elements 12, 14 in region 22 are generally linear from pivot 20 to a transition line T. At the transition line T, the handle elements 12, 14 curve outwardly in a configuration common to many types of hand tools. At the transition line T, the configuration of the two handle elements 12, 14 produces a maximum closed width W1, the significance of which will later be explained.

Each of the handle elements 12, 14 is offset at pivot 20. As such, the left/right orientation of the handle elements 12, 14 in region 24 is opposite of that in region 22. The offset at pivot 20 accomplishes an inversion in the handle elements in region 24, such that as shown in FIG. 1, handle element 12 becomes the top element in region 24 and handle element 14 becomes a bottom element in region 24. The offset also enables an increased opening to be gained in region 24 with a lesser length of handle element as compared to a non-offset handle element. This offset arrangement combined with a second offset arrangement utilized with jaw elements 16, 18 enables the outer diameter of the tool at pivot area 31 to be confined to essentially the same outer diameter dimensions of the jaw elements 16, 18 when the tool is fully opened, thus allowing access to long narrow areas.

In region 24, the two handle elements 12, 14 lay generally in parallel. However, a small gap 25 exists between the two handle elements in region 24 even when the pliers 10 are fully closed. It will be understood that since the handle elements 12, 14 in region 22 diverge away from one another, the handle elements 12, 14 in region 22 can be biased toward one another even when the pliers 10 are fully closed. By providing a gap 25 between the handle elements in region 24, the compression of the handle elements 12, 14 can be fully transferred to the jaw elements 16, 18 without the handle elements 12, 14 abutting against and interfering with one another. In a preferred embodiment, the length of the handle elements 12, 14 in region 22 is at least five times longer than the length of the handle elements 12, 14 in region 24. As such, the pivot configuration of the handle elements 12, 14 provides an initial mechanical advantage of at least 5:1 at the point where the handle elements 12, 14 engage the jaw elements 16, 18.

The jaw elements 16, 18 are pivotably coupled to one another by pivot 28. As such, the jaw elements 16, 18 are distinguishable into two regions 30, 32, wherein region 30 extends from the tail end of the jaw elements to pivot 28 and region 32 creates the working jaws for the overall plier construction. The two handle elements 12, 14 are pivotably connected to the jaw elements 16, 18 in region 31. As such, when the handle elements 12, 14 ire opened and closed, the jaw elements 16, 18 follow with the same motion.

When the pliers 10 are in a closed position, such as is shown in FIG. 1, it can be seen that the working surfaces 26, 27 of the jaw elements 16, 18 in region 32 are in abutment. However, a gap 34 exists between the jaw elements 16, 18 in region 30. This construction enables the jaw elements 16, 18 in region 30 to be biased towards one another by the handle elements 12, 14, thereby enabling a significant crushing force to be experienced by the jaw elements 16, 18 in region 32. Each of the jaw elements 16, 18 is offset at the point of pivot 28. As a result, the left/right orientation of the jaw elements 16, 18 in region 32 is opposite of that found in region 30. As explained previously, inclusion of this second offset in the jaw elements 16,18 (in combination with the first offset for the handle elements) in their prescribed lengths enables the outer diameter of the tool at pivot region 31 to be essentially the same as the outer diameter of the jaw elements at the working end of the tool 10 when in the fully open position. In a preferred embodiment, the length of region 30 of the jaw elements 16, 18 is approximately half as long as the length of the jaw elements 16, 18 in region 32. Consequently, the pivot configuration of the jaw elements 16, 18 provides a negative mechanical advantage of approximately 1:2.

The movement of the handle elements 12, 14 control the movement of the jaw elements 16, 18. Since the handle elements 12, 14 provide a mechanical advantage of at least 5:1 and the jaw elements provide a negative mechanical advantage of approximately 1:2, it should be understood that the overall set of pliers 10 provides a mechanical advantage of at least 2.5:1, wherein the force experienced at the jaws is at least 2.5 times that applied to the handles.

Figure 2:
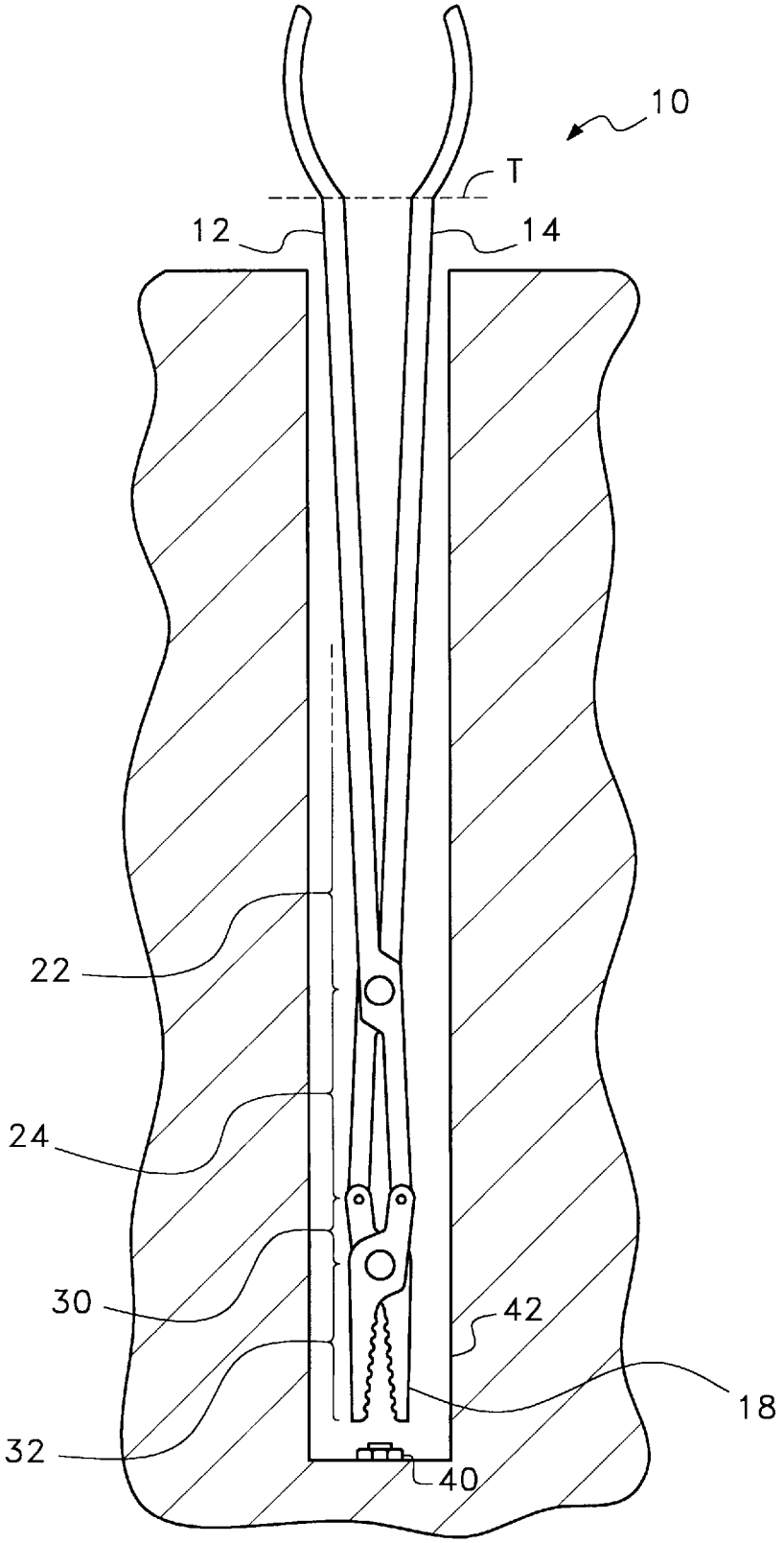
FIG. 2 is a side view of the embodiment of FIG. 1, wherein the pliers are shown in an open condition positioned within a narrow blind bore.

In a preferred embodiment, region 24 of the handle elements 12, 14 is approximately three times as long as the length of region 30 of the jaw elements 16, 18. Referring to FIG. 2, there is shown a specific application of the present invention pliers 10, wherein the pliers 10 are being used to engage an object 40 at the bottom of a deep bore 42 having, for example, a diameter of only two inches. Assuming that the length ratio between the length of region 22 and region 24 of the handle elements 12, 14 is approximately at a value of 5:1, the following performance characteristics can be obtained. The pliers 10 can be inserted into the bore 42 until the jaw elements 16, 18 reach the object 40 or until the transition line T reaches the top of the bore 42. In the shown example, both situations are shown as happening simultaneously. Allowing for the thickness of the handle elements 12, 14, the handle elements 12, 14, in the shown example, can be opened in a two inch diameter bore to a width of approximately 1.5 inches at the transition line T. Since the length ratio between region 22 and region 24 of the handle elements 12, 14 is 5:1, a 1.5 inch open width at the transition line F (if the transition line F is approximately ⅘ of the length the handle elements of region 22) results in an approximate inner diameter open width of ⅜ inches at the end of region 24. As region 24 of the handle elements 12, 14 is opened to ⅜ inches, region 30 of the jaw elements 16, 18 is also opened to an approximate width of ⅜ inches. Since the length ratio between the first region 30 and the second region 32 of the jaw elements 16, 18 is approximately 2:1, the ⅜ inch opening in the first region 30 of the jaw elements 16, 18 results in approximately a ¾ inch inner diameter opening of the plier jaws. Consequently, in a 2 inch diameter bore 42, the present invention pliers 10 are capable of engaging a ½ inch wide object and engage that object with a mechanical advantage of at least 2.5:1.

An important feature of the construction of the present invention pliers 10 is that the outer diameter of region 32 of the jaw elements 16, 18 opens to a width which is essentially the same or only slightly less than that of region 30 of the jaw elements 16, 18. As such, the jaws of the pliers can be opened to the maximum width allowable within an enclosed area, without concern for the width of the remaining portions of the jaw elements 16, 18. Moreover, even though the inner diameter of region 32 of the jaw elements 16, 18 opens approximately twice as large as that of region 30. the overall construction of the pliers 10 enables region 32 of the pliers 10 to have an overall mechanical advantage of at least approximately 2.5:1. Consequently, a plier construction is provided that is capable of providing a wide jaw opening in a highly confined area, yet provides a mechanical advantage to the jaw opening of approximately 2.5:1.

Figure 5:
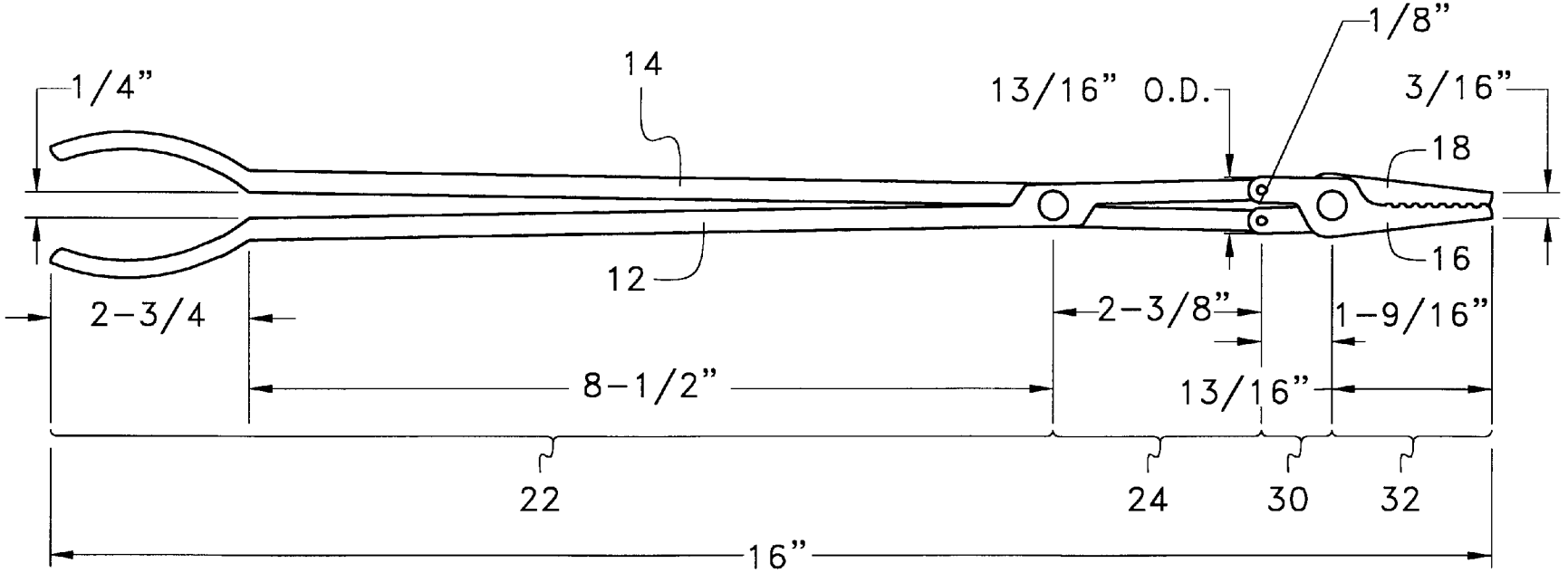
FIGS. 5–7 show another alternate embodiment of the present invention configured as a pair of pliers and illustrating exemplary dimensions of the various elements in different stages of use.

Referring to FIG. 5, an alternate preferred embodiment of the present invention has the following specific dimensions and operating characteristics. The overall length of the handle elements 12, 14 is approximately 13⅝ inches, where region 22 is approximately 11¼ inches and region 24 is 2⅜ inches in length. A preferred length from the transition line T to the first pivot 20 is approximately 8½ inches. The jaw elements 16, 18 have an overall length of 2⅜ inches, where region 30 is approximately 13/16 of an inch from the tail end to pivot 28 and region 32 is approximately 1 9/16 inches from the working end to pivot 28. Given these specific dimensions, the handle elements are able to provide a mechanical advantage of approximately 4.7:1 and the jaw elements provide a negative mechanical advantage of approximately 0.52. Thus, the overall mechanical advantage is calculated to be the product of the two ratios which gives an overall mechanical advantage of 2.46:1 or a mechanical advantage of greater than 2:1.

Figure 6:
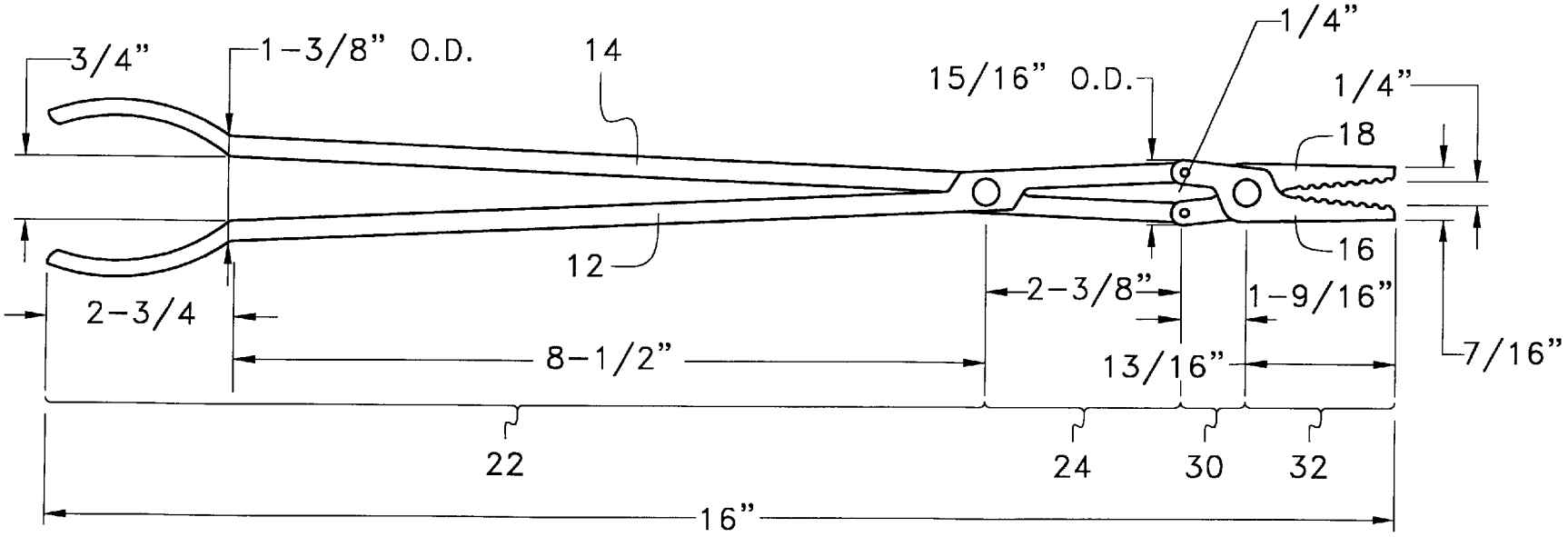
Figure 7:
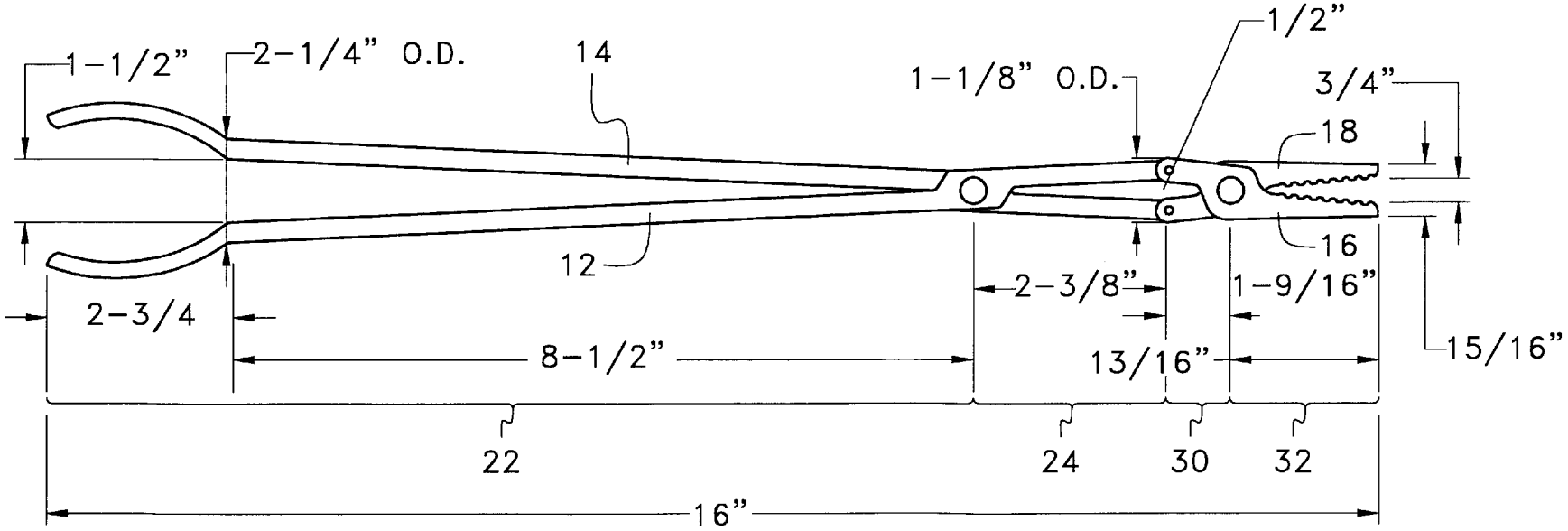

FIGS. 6 and 7 show the embodiment of FIG. 5 in different open stages with accompanying dimensional information. Given a nominal handle width of ⅜ inches, which provides ample rigidity for the tool when constructed of a hardened steel or other like material, the pivot region 31 in a fully open condition results in a 1½ inch outer diameter dimension. A corresponding outer diameter of the jaw elements 16, 18 in a fully open position (given a slight taper or curvature on the outside of the working end and alternatively on the inside of the jaw elements in the second region 32) results in an approximate 1 inch outer diameter dimension which is only slightly less than that of the pivot region 31. Accordingly, this alternate embodiment provides a rigid and stable construction which provides a mechanical advantage of at least 2:1.

It will be understood that the embodiments of the present invention specifically shown and described are merely exemplary and that a person skilled in the art can make alternate embodiments using different configurations and functionally equivalent components. For example, the overall length of the pliers can be varied. Similarly, the type of jaws can be modified to include cutters, C-clip spanners, and any other type of common jaw configuration.

Figure 3:
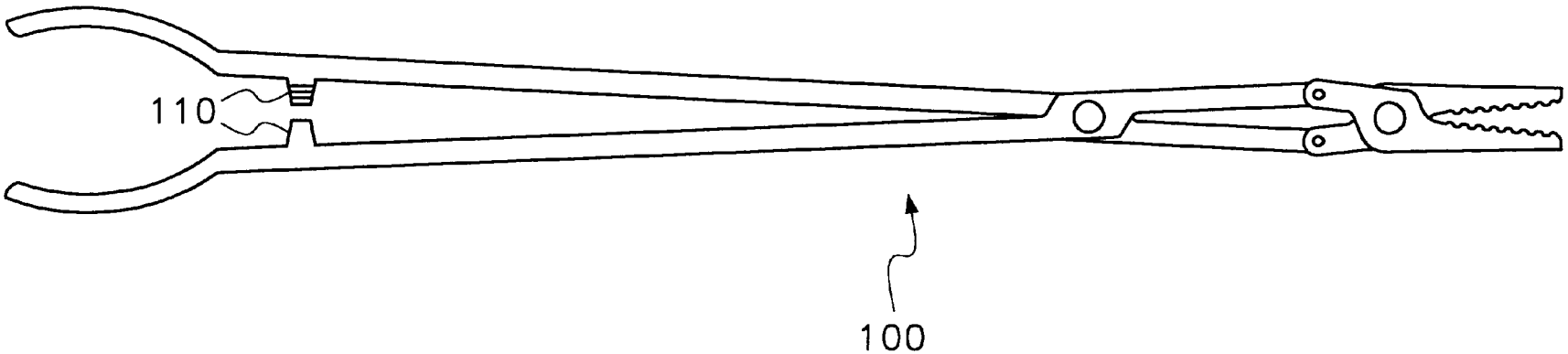
FIG. 3 is an alternate embodiment of the present invention configured for use as a hemostat.

Another advantageous embodiment of the present invention would take the form of a hemostat 100 for use in stopping bleeding during medical procedures, as shown in FIG. 3. As would be understood, the hemostat device includes a clamping or locking mechanism 110 which could be engaged in order to maintain a given pressure between the jaw regions. The extended reach configuration for such a device is advantageous in that trauma to regions under repair may be lessened since the size of an access opening is greatly reduced.

Figure 4:
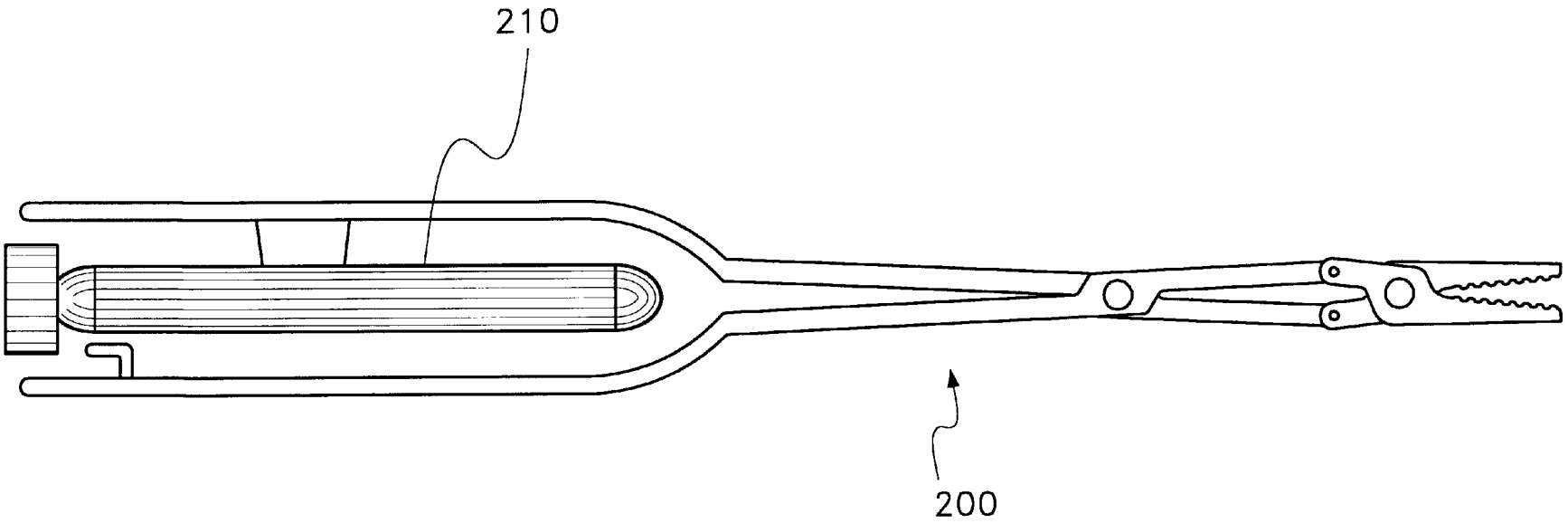
FIG. 4 is a second alternate embodiment of the present invention configured for use as safety wire pliers/twisters.

Another advantageous application for the present invention is for use as safety wire pliers/twisters 200, as shown in FIG. 4. As would be understood by a person skilled in the art, safety wile pliers/twisters are commonly utilized in the aircraft, aerospace, automotive, automotive racing and other industries to provide hardware integrity between two points in an environment subjected to a substantial amount of vibrational activity. The safety wire pliers/twisters are advantageous in that they enable safety wires to be fastened and unfastened at locations that otherwise would not be accessible. In such an embodiment, the safety wire pliers would include a wire twisting element 210 which couples between the handle elements as shown, the configuration of which would be well-known to a person skilled in the art. All such alternate embodiments are intended to be included in the scope of this invention as set forth in the following claims.

What is claimed is:

1. A tool, comprising:

two halindle elements, wherein each handle element has a first end and a second end;

a first pivot joining each handle element together between said first end and said second end, wherein the distance between said first end and said first pivot is more than twice as long as the distance between said second end and said first pivot;

two jaw elements, wherein each jaw element has a working head end and an opposite tail end and wherein the tail end of said two jaw elements is pivotably connected to the second end of said two handle elements, respectively;

a second pivot joining each jaw element together between said working head end and said tail end, wherein the distance between said working head end and said second pivot is at least twice as long as the distance between said tail end and said second pivot; and wherein the distance between the second end and said first pivot on each handle element is at least approximately three times longer than the distance between said tail end and said second pivot on each jaw element.

2. The tool according to claim 1, wherein each of said two handle elements is coupled in a first offset arrangement at said first pivot and wherein each of said two jaw elements is coupled in a second offset arrangement at said second pivot.

3. Tie tool according to claim 2, wherein each of said two handle elements is offset between said second end and said first pivot relative a portion of said handle elements between said first end and said first pivot, and wherein each of said two jaw elements is offset between said tail end and said second pivot relative said working head end.

4. The tool according to claim 3, wherein said two handle elements and said two jaw elements couple to one another at a third pivot region, wherein an outer diameter of said tool at said third pivot region is substantially similar to an outer diameter of said jaw elements at said working head end when said tool is in a fully open position.

5. The tool according to claim 2, wherein said handle elements are configured so that the handle elements between said first pivot and each said second end lay substantially parallel with respect to one another when said tool is in said closed position, whereby an open gap exists between said handle elements at said second end.

6. The tool according to claim 2, wherein said jaw elements are configured so that the jaw elements between said second pivot and each said tail end lay substantially parallel with respect to one another when said tool is in said closed position, whereby an open gap exists between said jaw elements.

7. The tool according to claim 1, wherein the distance between said first end and said first pivot on each handle element is at least five times as long as said the distance between said second end and said first pivot.

8. The tool accordingly to claim 7, wherein said tool provides a mechanical advantage to said jaws of at least 2.5:1.

9. The tool according to claim 1, wherein said tool is selectively adjustable between an open position, where each said working head end of said jaw elements are separated, and a closed position where each said working head end of said jaw elements are in abutment.

10. The tool according to claim 9, wherein said handle elements are configured so that the handle elements between said first pivot and each said first end diverge away from each other at an acute angle when said tool is in said closed position.

11. The tool according to claim 10, wherein said acute angle is between one degree and five degrees.

12. The tool according to claim 1 wherein said tool is configured to be a pair of pliers.

13. The tool according to claim 1, further including a latching mechanism engageable to maintain a given pressure between said jaw elements.

14. The tool according to claim 13, wherein said tool is configured as a hemostat.

15. The tool according to claim 1, further including a wire twisting element coupled between said handle elements, wherein said tool is configured as wire twisting pliers.

16. A pair of pliers, comprising:

two jaw elements joined together at first pivot point wherein said jaw elements are at least approximately twice as long on a first side of said first pivot point than on an opposite second side of said first pivot point;

two handle elements joined together at a second pivot point, wherein said handle elements are at least four and one half times longer on a first side of said second pivot than on the opposite second side of said second pivot point;

wherein said handle elements on the second side of said second pivot point are coupled to the second side of said jaw elements, wherein each of said two handle elements is coupled in a first offset arrangement at said first pivot and wherein each of said two jaw elements is coupled in a second offset arrangement at said second pivot, an overall mechanical advantage being provided to said pliers of at least 2:1 at said first side of said jaw elements.

17. The pliers according to claim 16, wherein each of said two handle elements is offset between said second end and said first pivot relative a portion of said handle elements between said second end and said first pivot, and wherein each of said two jaw elements is offset between said tail end and said second pivot relative said working head end.

18. The pliers according to claim 17, wherein said pliers are selectively positionable between an open position and a closed position and there is a less than five degree difference between said two handle elements at said open position and said closed position.

19. The pliers according to claim 17, wherein said handle elements on the second side of said second pivot point are at least three times longer than the second side of said jaw elements.

20. The pliers according to claim 17, wherein said two handle elements and said two jaw elements couple to one another at a third pivot region, wherein an outer diameter of said tool at said third pivot region is substantially similar to an outer diameter of said jaw Celite its at said working head end when said pliers are in a fully open position.

* * * * *